US006013366A

United States Patent [19]

Kent et al.

[11] Patent Number: 6,013,366

[45] Date of Patent: Jan. 11, 2000

[54] MELAMINE FIBER-CONTAINING FABRICS WITH IMPROVED COMFORT

[75] Inventors: George M. Kent, Arden, N.C.; Karl Ott, Plankstadt, Germany

[73] Assignee: BASF Corporation, Mt. Olive, N.J.

[21] Appl. No.: 09/164,484

[22] Filed: Oct. 1, 1998

Related U.S. Application Data

[62] Division of application No. 08/941,989, Oct. 1, 1997, Pat. No. 5,853,880.

[51] Int. Cl.[7] ..... D02G 3/00

[52] U.S. Cl. ..... 428/364; 428/362

[58] Field of Search ..... 428/364, 362, 428/370, 373, 357

[56] References Cited

U.S. PATENT DOCUMENTS

| | | | |
|---|---|---|---|
| 4,225,442 | 9/1980 | Tremblay et al. | 210/497.1 |
| 4,392,341 | 7/1983 | Grill | 57/90 |
| 4,547,933 | 10/1985 | Lauterbach | 19/0.35 |
| 4,832,102 | 5/1989 | Domchick | 152/527 |
| 4,893,665 | 1/1990 | Reuter et al. | 152/451 |
| 5,487,941 | 1/1996 | Pepin | 428/364 |
| 5,551,498 | 9/1996 | Komatsuki | 152/527 |
| 5,560,990 | 10/1996 | Ilg | 428/362 |
| 5,849,648 | 12/1998 | Kent et al. | 442/414 |
| 5,918,453 | 7/1999 | Kent et al. | 57/75 |

*Primary Examiner*—Newton Edwards
*Attorney, Agent, or Firm*—Laura D. Nammo

[57] ABSTRACT

Fabrics containing melamine fibers are rendered more comfortable by carding the melamine fibers under vacuum so as to exhibit a narrower fiber diameter distribution ($\delta_d$) and/or a narrower staple length distribution ($\delta_1$) as compared to melamine fibers which are carded in the absence of vacuum. In addition, more comfortable melamine fiber-containing yarns are produced by spinning the staple fiber at a lower twist multiplier (TM) as compared to conventional melamine fiber yarns. Most preferably, the melamine fiber-containing fabrics and yarns will be blended with at least one other type of synthetic fibers, such as aramid fibers.

6 Claims, No Drawings

MELAMINE FIBER-CONTAINING FABRICS WITH IMPROVED COMFORT

This application is a divisional of application Ser. No. 08/941,989 filed on Oct. 1, 1997, now U.S. Pat. No. 5,853, 880.

FIELD OF THE INVENTION

The present invention relates generally to the field of melamine fibers. In specific forms, the present invention is embodied in blends of melamine fibers with other synthetic fibers (e.g., aramid fibers) which exhibit improved hand, and thereby improved comfort when employed in garment fabrics.

BACKGROUND AND SUMMARY OF THE INVENTION

Melamine staple fibers, because of the method by which they are produced, contain staple fibers of different lengths and diameters. During cutting and sewing of garments and when fabrics containing melamine fibers are worn, there is the potential for (i) larger diameter fibers to protrude from the fabric and/or (ii) the shorter length fibers to be dislodged from the fabrics and fall onto a person's skin. In each case, a physical discomfort may result.

According to the present invention, fabrics containing melamine fibers are rendered more comfortable. Broadly, therefore, the present invention is embodied in fabrics which include melamine fibers having improved hand, and thereby greater comfort. In accordance with the present invention, the melamine fibers are carded under vacuum so as to exhibit a narrower fiber diameter distribution ($\delta_d$) and/or a narrower staple length distribution ($\delta_1$) as compared to melamine fibers which are carded in the absence of vacuum. In addition, yarns spun from such melamine staple fiber will have a lower twist multiplier (TM) as compared to conventional melamine fiber yarns.

These and other aspects and advantages of the present invention will become more clear after careful consideration is given to the following detailed description of the preferred exemplary embodiments.

DETAILED DESCRIPTION OF THE INVENTION

The term "fibers" as used herein is meant to refer to staple fibers of varying lengths. The term "sliver" is a continuous strand of loosely assembled fibers without twist. A "roving" is a sliver that has been condensed for presentation to a staple fiber spinning frame (i.e., prior to being spun into a yarn).

The melamine fibers that may be employed in the present invention are those produced from highly concentrated solutions of melamine-formaldehyde precondensation products, after addition of an acidic curing agent, by rotospinning, drawing out, extrusion or fibrillation. The fibers obtained are generally predried with or without stretching and the melamine resin is usually cured at from 120° C. to 250° C. The fibers are usually from about 0.3 to about 8 denier and from about 0.5 to about 8 inches in length. Particularly, thermally stable fibers are obtained when up to 30 mole %, in particular from 2 to 20 mole %, of the melamine in the melamine resin is replaced by a hydroxalkylmelamine. Such fibers have a sustained use temperature of up to 200° C., preferably up to 220° C. In addition, minor amounts of melamine can be replaced by substituted melamines, urea or phenol The melamine fibers are most preferably blended with another synthetic filament in order to achieve the desired yarns properties. Preferably, however, the melamine fibers are blended with aramid fibers, as disclosed more completely in U.S. Pat. No. 5,560,990 to llg et al (the entire content of which is expressly incorporated hereinto by reference. More specifically, the melamine fibers will be present in the blends in an amount between about 5 to about 95 parts by weight, with aramid fibers being present in an amount between about 95 to about 5 parts by weight.

The melamine fibers and any other fibers blended therewith are subjected to a carding process which eliminates the larger diameter and longer length staple fibers. Specifically, according to the present invention, the melamine fibers are subjected to carding under the influence of vacuum so as that at least about 90%, and more typically at least about 95% of the melamine fibers in the resulting sliver will have a staple fiber length of between about 1.0 inch to about 5.0 inches, and a diameter of between about 0.3 to about 4.0 denier per filament (dpf). Most preferably, carding is accomplished using a conventional Truetzschler carding system.

The resulting sliver may then be formed into a roving which can be presented to the spinning frame. In this regard, the yarn spun from the roving most preferably has a twist multiplier value (TM) of less than about 4.0, and more preferably less than about 3.5. The "twist multiplier value" is equal to the twist per inch (tpi) of the yarn, divided by the square root of the yarn size in cotton count.

A further understanding of this invention is available from the following non-limiting example thereof.

EXAMPLE

Slivers were formed from a blend of melamine resin fibers (BASOFIL® fibers, BASF Corporation) and aramid fibers (KEVLAR® fibers, DuPont) by carding the blend in respective carding systems in the absence (the "Control"), and under the influence (the "Invention") of, vacuum. Following carding, the resulting slivers were drawn two times to improve blending and orientation. In each drawing step, 8 to 10 ends of card sliver were brought together and drafted down to a sliver approximately the size of each individual sliver. The drawn sliver was then formed into an oriented and low-twist roving which was presented to the spinning frame.

The rovings were spun on a "cotton system" short staple ring spinning frame by drafting it down to a desired yarn count and then adding a certain degree of twist. Two strands of yarn were then ply twisted together. The properties of the Control and Invention yarns are set forth in the Table below. In this regard, the yarn counts of the singles yarns were an estimate from the two ply yarn (i.e., it was assumed that the yarn count of the singles yarns was one-half of the two-ply yarn count). Furthermore, the twists per inch of each singles yarn were estimated based on the fact that the twists of the two-ply yarn are typically 60% of the single strand twist.

| | Control Yarn | Invention Yarn |
|---|---|---|
| Melamine Fiber Content | 40% | 46% |
| Plied Yarn Denier | 628 | 668 |
| Singles Yarn Denier (est.) | 314 | 334 |
| Cotton Count, Plied Yarn | 33.8 | 31.8 |
| Cotton Count, Singles Yarn (est.) | 16.9 | 15.9 |
| Tenacity, gpd | 3.8 | 4.4 |
| Modulus at 3%, gpd | 43.1 | 72.1 |

-continued

| | Control Yarn | Invention Yarn |
|---|---|---|
| Breaking elongation, % | 6.2 | 5.7 |
| Ply twist, tpi | 11 | 7.7 |
| Singles Yarn Twist (est.) | 18.0 | 12.8 |
| Singles Yarn Twist Multiplier, TM | 4.37 | 3.21 |

Fabrics of the same construction were produced from the two-ply yarns. In this regard, a plain weave ripstop construction was used, with a fabric weight of approximately 7.5 ounces per square yarn. The rip stop construction included two ends or pick together after every eight ends or pick in the normal plain weave so as to create a slightly raised square pattern in the fabric making the feel of the fabric, if scratchy, even more noticeably apparent.

The fabric produced from the Control Yarn gave a scratchy feel, whereas the fabric from the Invention Yarn had a much softer, smoother feel. Garments made from the fabric of the Invention Yarn were also observed to not only be less scratchy, but also to have significantly less cutting lint and/or short fibers during garment production.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A yarn including melamine fibers, wherein at least 90% of the melamine fibers have a staple fiber length of about 1.0 inch to about 5.0 inches and a diameter of about 0.3 to about 4.0 denier per filament, and having a twist multiplier of less than 4.0.

2. The yarn of claim 1, having a twist multiplier value of less than 3.5.

3. The yarn of claim 1, wherein at least 95% of the melamine fibers have a staple fiber length of about 1.0 inch to about 5.0 inches, and a diameter of about 0.3 to about 4.0 denier per filament.

4. The yarn of claim 1, which further comprises at least one other type of synthetic fibers.

5. The yarn of claim 4, wherein said one other type of synthetic fibers include aramid fibers.

6. The yarn of claim 5, wherein said melamine fibers are present in an amount of between about 5 to about 95 parts by weight, and wherein said aramid fibers are present in an amount between about 95 to about 5 parts by weight.

* * * * *